US006903018B2

(12) United States Patent
Sabde et al.

(10) Patent No.: US 6,903,018 B2
(45) Date of Patent: Jun. 7, 2005

(54) METHODS AND APPARATUSES FOR PLANARIZING MICROELECTRONIC SUBSTRATE ASSEMBLIES

(75) Inventors: Gundu M. Sabde, Boise, ID (US); Whonchee Lee, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 448 days.

(21) Appl. No.: 09/915,658

(22) Filed: Jul. 25, 2001

(65) Prior Publication Data

US 2001/0055936 A1 Dec. 27, 2001

Related U.S. Application Data

(62) Division of application No. 09/356,808, filed on Jul. 20, 1999, now Pat. No. 6,306,012.

(51) Int. Cl.[7] ..... H01L 21/302
(52) U.S. Cl. ..... 438/690; 438/691
(58) Field of Search ..... 438/690, 691, 438/692, 693; 252/79.1; 451/41

(56) References Cited

U.S. PATENT DOCUMENTS

| | | | | |
|---|---|---|---|---|
| 3,617,320 A | * | 11/1971 | Lee | 106/198.1 |
| 5,380,528 A | * | 1/1995 | Alban et al. | 424/401 |
| 5,554,320 A | | 9/1996 | Yianakopoulos | 252/389.23 |
| 5,620,946 A | | 4/1997 | Jahnke et al. | 507/131 |
| 5,722,877 A | | 3/1998 | Meyer et al. | 451/41 |
| 5,782,675 A | | 7/1998 | Southwick | 451/56 |
| 5,916,012 A | | 6/1999 | Pant et al. | 451/41 |
| 5,958,794 A | * | 9/1999 | Bruxvoort et al. | 438/692 |
| 5,972,792 A | * | 10/1999 | Hudson | 438/691 |
| 5,989,111 A | | 11/1999 | Lamphere et al. | 451/526 |
| 5,997,384 A | | 12/1999 | Blalock | 451/41 |
| 6,039,633 A | * | 3/2000 | Chopra | 451/41 |
| 6,054,015 A | | 4/2000 | Brunelli et al. | 156/345 |
| 6,062,958 A | | 5/2000 | Wright et al. | 451/288 |
| 6,124,207 A | | 9/2000 | Robinson et al. | 438/692 |
| 6,165,061 A | | 12/2000 | Fujii et al. | 451/533 |
| 6,200,896 B1 | * | 3/2001 | Sethuraman et al. | 438/691 |
| 6,206,756 B1 | * | 3/2001 | Chopra et al. | 451/28 |
| 6,267,644 B1 | | 7/2001 | Molnar | 451/41 |
| 6,276,996 B1 | * | 8/2001 | Chopra | 451/41 |
| 6,291,407 B1 | * | 9/2001 | Reidmeyer | 508/114 |
| 6,302,766 B1 | * | 10/2001 | Sethuraman et al. | 451/41 |
| 6,325,705 B2 | | 12/2001 | Burke et al. | 451/288 |
| 6,572,453 B1 | * | 6/2003 | Wijekoon et al. | 451/56 |
| 6,634,927 B1 | | 10/2003 | Molnar | 451/8 |

FOREIGN PATENT DOCUMENTS

| | | | |
|---|---|---|---|
| JP | 10034514 | 2/1998 | B24B/21/00 |
| WO | WO 97/11484 | 3/1997 | H01L/21/3105 |

* cited by examiner

*Primary Examiner*—Kin-Chan Chen
(74) *Attorney, Agent, or Firm*—Dorsey & Whitney LLP

(57) ABSTRACT

Methods and apparatuses for planarizing microelectronic substrate assemblies on fixed-abrasive polishing pads with non-abrasive lubricating planarizing solutions. One aspect of the invention is to deposit a lubricating planarizing solution without abrasive particles onto a fixed-abrasive polishing pad having a body, a planarizing surface on the body, and a plurality of abrasive particles fixedly attached to the body at the planarizing surface. The front face of a substrate assembly is pressed against the lubricating planarizing solution and at least a portion of the fixed abrasive particles on the planarizing surface of the polishing pad. At least one of the polishing pad or the substrate assembly is then moved with respect to the other to impart relative motion therebetween. As the substrate assembly moves relative to the polishing pad, regions of the front face are separated from the abrasive particles in the polishing pad by a lubricant-additive in the lubricating planarizing solution.

8 Claims, 4 Drawing Sheets

METHODS AND APPARATUSES FOR PLANARIZING MICROELECTRONIC SUBSTRATE ASSEMBLIES

CROSS-REFERENCE TO RELATED APPLICATION

This application is a divisional of U.S. patent application Ser. No. 09/356,808, filed Jul. 20, 1999, now U.S. Pat. No. 6,306,012.

TECHNICAL FIELD

BACKGROUND OF THE INVENTION

Mechanical and chemical-mechanical planarizing processes (collectively "CMP") are used in the manufacturing of electronic devices for forming a flat surface on semiconductor wafers, field emission displays and many other microelectronic substrate assemblies. CMP processes generally remove material from a substrate assembly to create a highly planar surface at a precise elevation in the layers of material on the substrate assembly.

FIG. 1 is a schematic isometric view of a web-format planarizing machine 10 for planarizing a microelectronic substrate assembly 12. The planarizing machine 10 has a table 11 with a rigid panel or plate to provide a flat, solid support surface 13 for supporting a portion of a web-format planarizing pad 40 in a planarizing zone "A." The planarizing machine 10 also has a pad advancing mechanism including a plurality of rollers to guide, position, and hold the web-format pad 40 over the support surface 13. The pad advancing mechanism generally includes a supply roller 20, first and second idler rollers 21*a* and 21*b*, first and second guide rollers 22*a* and 22*b*, and a take-up roller 23. As explained below, a motor (not shown) drives the take-up roller 23 to advance the pad 40 across the support surface 13 along a travel axis T—T. The motor can also drive the supply roller 20. The first idler roller 21*a* and the first guide roller 22*a* press an operative portion of the pad against the support surface 13 to hold the pad 40 stationary during operation.

The planarizing machine 10 also has a carrier assembly 30 to translate the substrate assembly 12 across the pad 40. In one embodiment, the carrier assembly 30 has a head 32 to pick up, hold and release the substrate assembly 12 at appropriate stages of the planarizing process. The carrier assembly 30 also has a support gantry 34 and a drive assembly 35 that can move along the gantry 34. The drive assembly 35 has an actuator 36, a drive shaft 37 coupled to the actuator 36, and an arm 38 projecting from the drive shaft 37. The arm 38 carries the head 32 via another shaft 39. The actuator 36 orbits the head 32 about an axis B—B to move the substrate assembly 12 across the pad 40.

The polishing pad 40 may be a non-abrasive polymeric pad (e.g., polyurethane), or it may be a fixed-abrasive polishing pad in which abrasive particles are fixedly dispersed in a resin or another type of suspension medium. FIG. 2A, for example, is an isometric view of a fixed-abrasive polishing pad having a body 41 including a backing film 42 and a planarizing medium 43 on the backing film 42. The backing film 42 can be a thin sheet of Mylar® or other flexible, high-strength materials. The abrasive planarizing medium 43 generally includes a resin binder 44 and a plurality of abrasive particles 45 distributed throughout the resin binder 44. The planarizing medium 43 is generally textured to form a planarizing surface 46 having a plurality of truncated pyramids, cylindrical columns, or other raised features. The 3M Corporation of St. Paul, Minn., for example, manufactures several fixed-abrasive polishing pads having alumina, ceria or other abrasive particles fixedly bonded to a Mylar® backing film 42 by a resin binder.

Referring again to FIG. 1, a planarizing fluid 50 flows from a plurality of nozzles 49 during planarization of the substrate assembly 12. The planarizing fluid 50 may be a conventional CMP slurry with abrasive particles and chemicals that etch and/or oxidize the surface of the substrate assembly 12, or the planarizing fluid 50 may be a "clean" non-abrasive planarizing solution without abrasive particles. In most CMP applications, abrasive slurries with abrasive particles are used on non-abrasive polishing pads, and non-abrasive clean solutions without abrasive particles are used on fixed-abrasive polishing pads.

In the operation of the planarizing machine 10, the pad 40 moves across the support surface 13 along the pad travel path T—T either during or between planarizing cycles to change the particular portion of the polishing pad 40 in the planarizing zone A. For example, the supply and take-up rollers 20 and 23 can drive the polishing pad 40 between planarizing cycles such that a point P moves incrementally across the support surface 13 to a number of intermediate locations $I_1$, $I_2$, etc. Alternatively, the rollers 20 and 23 may drive the polishing pad 40 between planarizing cycles such that the point P moves all the way across the support surface 13 to completely remove a used portion of the pad 40 from the planarizing zone A. The rollers may also continuously drive the polishing pad 40 at a slow rate during a planarizing cycle such that the point P moves continuously across the support surface 13. Thus, the polishing pad 40 should be free to move axially over the length of the support surface 13 along the pad travel path T—T.

CMP processes should consistently and accurately produce a uniform, planar surface on substrate assemblies to enable circuit and device patterns to be formed with photolithography techniques. As the density of integrated circuits increases, it is often necessary to accurately focus the critical dimensions of the photo-patterns to within a tolerance of approximately 0.1 $\mu$m. Focusing photo-patterns to such small tolerances, however, is difficult when the planarized surfaces of substrate assemblies are not uniformly planar. Thus, to be effective, CMP processes should create highly uniform, planar surfaces on substrate assemblies.

The planarity of the finished substrate surface is a function of several factors, one of which is the distribution of abrasive particles under the substrate assembly during planarization. In certain applications that use a non-abrasive pad and an abrasive slurry, the distribution of abrasive particles under the substrate assembly may not be uniform because the edge of the substrate assembly wipes the slurry off of the pad such that the center region of the substrate assembly does not consistently contact abrasive particles. The center region of the substrate assembly may accordingly have a different polishing rate than the edge region causing a center-to-edge polishing gradient across the substrate assembly.

Fixed abrasive polishing pads, like the one shown in FIG. 2A, are relatively new and have the potential to produce highly planar surfaces. The primary technical advance of fixed-abrasive pads is that the distribution of abrasive particles under the substrate assembly is not a function of the distribution of the planarizing solution because the abrasive particles are fixedly attached to the pad. Fixed abrasive pads accordingly provide a more uniform distribution of abrasive particles under the substrate assembly 12 than abrasive slurries on non-abrasive pads. Fixed-abrasive polishing pads, however, may scratch or otherwise produce defects on the finished substrate surface. The particular mechanism that causes scratching and defects is not completely understood, but it is expected that large pieces 47 of the fixed-abrasive planarizing medium 43 (see FIG. 2) break away during planarization and scratch the substrate assembly 12. Fixed-abrasive pads may also produce defects because, unlike abrasive slurries in which the abrasive particles are mobile and can move with the slurry, the abrasive particles in fixed-abrasive pads do not roll or move with the substrate assembly. As such, minor peaks on the raised features of the planarizing surface 46 or disparities in the size or shape of the fixed-abrasive particles 45 may scratch the substrate surface. Therefore, even though fixed-abrasive pads are promising, they may scratch the finished substrate surface of microelectronic substrate assemblies or otherwise produce defects in the integrated circuits.

SUMMARY OF THE INVENTION

The present invention relates to planarizing microelectronic substrate assemblies on fixed-abrasive polishing pads with non-abrasive planarizing solutions. One aspect of the invention is to deposit a lubricating planarizing solution without abrasive particles onto a fixed-abrasive polishing pad having a body, a planarizing surface on the body, and a plurality of abrasive particles fixedly attached to the body at the planarizing surface. The front face of a substrate assembly is pressed against the lubricating planarizing solution and at least a portion of the planarizing surface of the polishing pad. At least one of the polishing pad or the substrate assembly is then moved with respect to the other to impart relative motion therebetween. As the substrate assembly moves relative to the polishing pad, regions of the front face are separated from the abrasive particles in the polishing pad by a lubricant-additive in the planarizing solution.

In one particular application, separating the regions of the front face of the substrate assembly from the abrasive particles involves dissolving the lubricant-additive into a non-abrasive solution to form the lubricating planarizing solution, and then depositing the lubricating planarizing solution onto the polishing pad as the substrate assembly moves relative to the polishing pad. The lubricant-additive can be glycerol, polyethylene glycol, polypropylene glycol, CARBOPOL® (which includes homo- and copolymers of acrylic acid crosslinked with a polyalkenyl polyether) manufactured by B.F. Goodrich, polyvinyl alcohol, POLYOX® (which includes ethylene oxide polymers) manufactured by Union Carbide, or some other lubricating liquid. The concentration of the lubricant-additive in the non-abrasive solution is selected so that the lubricating planarizing solution has a viscosity of at least approximately 4–100 cp, and more generally 10–20 cp. In operation, the lubricating planarizing solution provides a protective boundary layer between the front face of the substrate assembly and the abrasive planarizing surface to inhibit the fixed abrasive particles from overly abrading the substrate assembly. Thus, compared to planarizing solutions without the lubricant-additive, the lubricating planarizing solution is expected to reduce defects and scratches on the front face of the substrate assembly in fixed-abrasive planarization.

DETAILED DESCRIPTION OF THE INVENTION

The present invention relates to planarizing microelectronic substrate assemblies on fixed-abrasive polishing pads with non-abrasive lubricating planarizing solutions. Several aspects and details of certain embodiments of this invention are described in detail below, and illustrated in FIGS. 3 and 4, to provide a thorough understanding of making and using these embodiments of the invention. It will be appreciated, however, that particular details may be omitted from some of the embodiments, or that there may be additional embodiments of the invention that are covered by the following claims.

Figure 1:
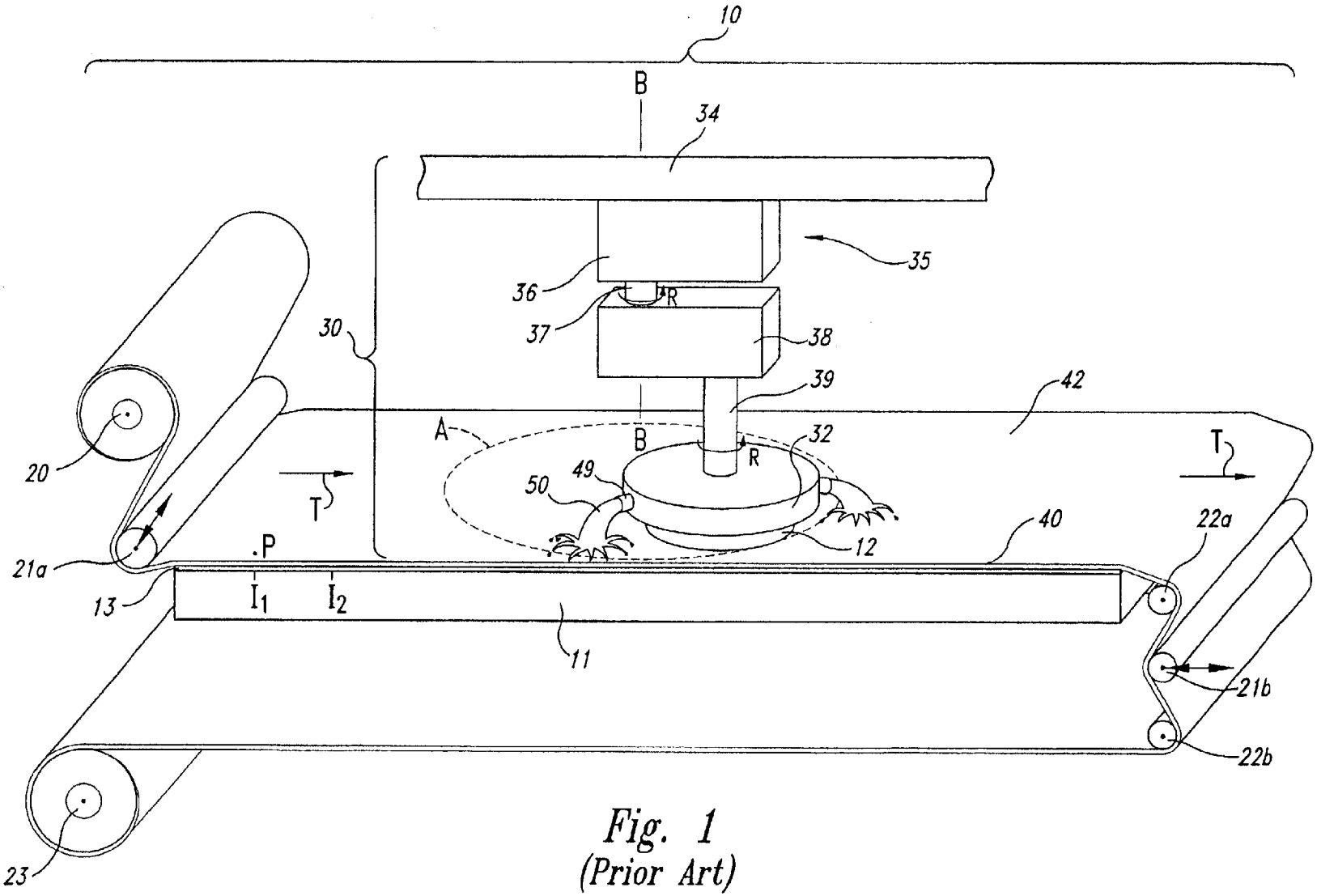
Fig. 1 (Prior Art)
FIG. 1 is a schematic isometric view of a planarizing machine in accordance with the prior art.
Figure 3:
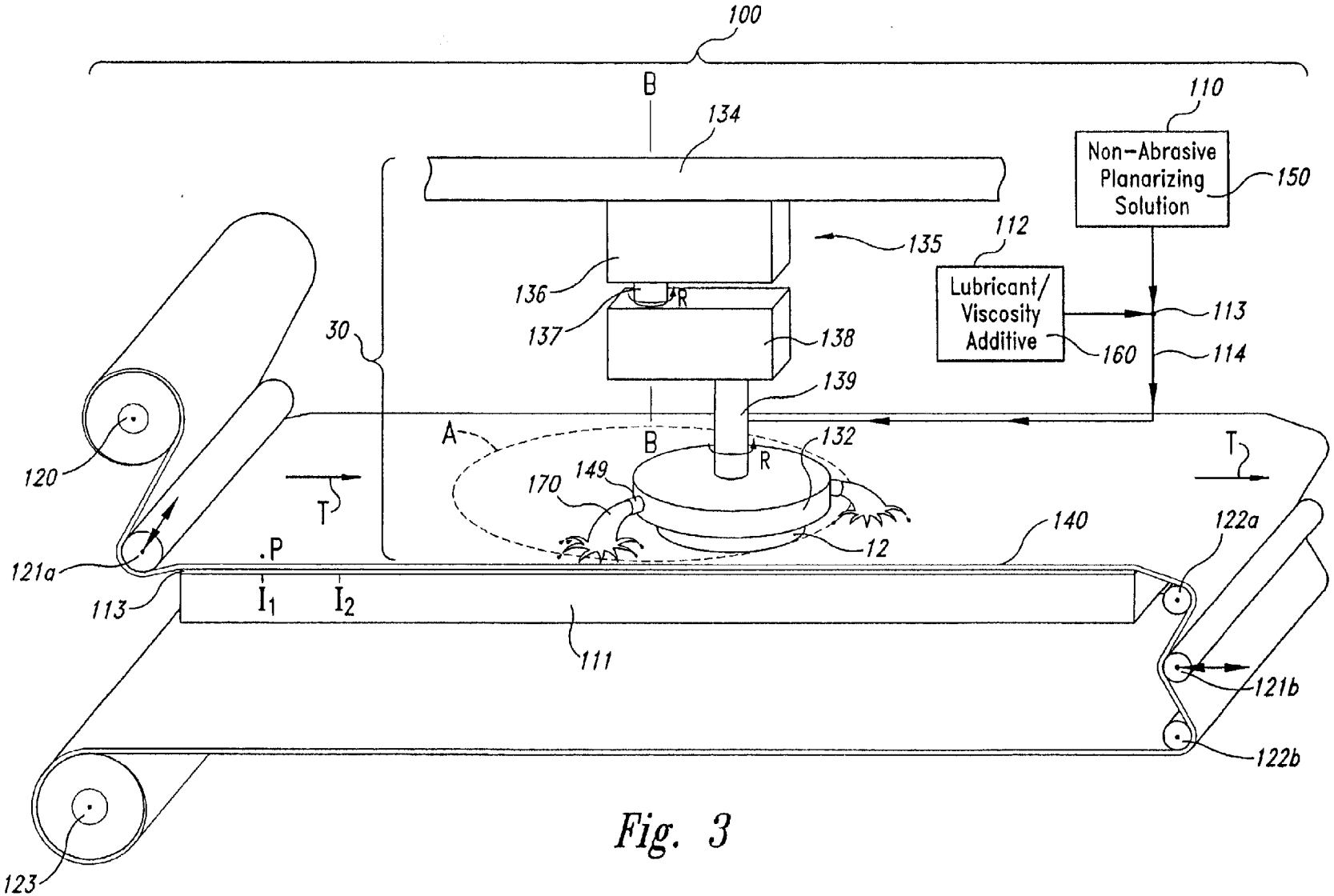
FIG. 3 is a schematic isometric view of a web-format planarizing machine used in accordance with an embodiment of the invention.

FIG. 3 is a schematic isometric view of a web-format planarizing machine 100 for planarizing a microelectronic substrate assembly 12 in accordance with an embodiment of the invention. The planarizing machine 100 includes a table 111 having a support surface 113, a carrier assembly 130 over the table 111, and a polishing pad 140 on the support surface 113. The table 111, support surface 113 and carrier assembly 130 can be substantially the same as those described above with reference to FIG. 1. The polishing pad 140 is coupled to a pad advancing mechanism having a plurality of rollers 120, 121*a*, 121*b*, 122*a*, 122*b* and 123. The pad advancing mechanism can also be the same as that described above with reference to FIG. 1. The planarizing machine 100 further includes a first container 110 holding a supply of a non-abrasive solution 150 and a second container 112 holding a supply of a lubricant-additive 160.

The non-abrasive solution 150 can be an aqueous planarizing solution containing water, oxidants, surfactants, and other non-abrasive materials. The non-abrasive solution 150 does not contain abrasive particles that are commonly used in abrasive CMP slurries (e.g., alumina, ceria, titania, titanium, silica or other abrasive particles). For example, the non-abrasive solution 150 can contain water and either ammonia or potassium hydroxide. The non-abrasive solution 150, more specifically, can include 65–99.9% of deionized water and 0.1–35% of either $NH_4OH$, $NH_4NO_3$, $NH_4Cl$ or KOH. The non-abrasive solution 150 also generally has a viscosity of 1.0–2.0 cp and a pH of 2.0–13.5, and generally a pH of 9.0–13.0. In general, the non-abrasive solution 150 is selected to etch and/or oxidize the materials at the surface of the substrate assembly 12. The non-abrasive solution 150, therefore, may have compositions other than water and either ammonia or potassium hydroxide.

The lubricant-additive 160 is a separate solution or dry chemical compound that increases the viscosity of the non-abrasive solution 150 without altering the chemical effects of the non-abrasive solution 150 on the substrate assembly 12 during planarization. The lubricant-additive 160 can be glycerol, polyethylene glycol polypropylene glycol, polyvinyl alcohol, CARBOPOL® manufactured by BF Goodrich, or POLYOX® manufactured by Union Carbide. It will be appreciated that the lubricant-additive 160 may be composed of other lubricants suitable for contact with the substrate assembly 12.

The lubricant-additive 160 is combined with the non-abrasive solution 150 to make a lubricating planarizing solution 170. The concentration of the lubricant-additive 160 in the non-abrasive solution 150 is generally selected so that the lubricating planarizing solution 170 has a viscosity of at least approximately 4–100 cp, and more preferably 10–20 cp. The particular composition of the lubricating planarizing solution 170 will generally depend, at least in part, upon the type of abrasive particles in the pad, the shape of the raised features on the pad, and the types of material on the substrate assembly 12. The lubricating planarizing solution 170 can include the following ranges of non-abrasive solution 150 and lubricant-additive 160: (A) 90%–99.9% ammonia and water, and 0.1–10% POLYOX® or CARBOPOL®; or (B) 80%–95% ammonia and water, and 5–20% glycerol, polyethylene glycol or polypropylene glycol. The following compositions of lubricating planarizing solutions 170 are thus offered by way of example, not limitation:

| | |
|---|---|
| | COMPOSITION 1 |
| 0.25% weight | POLYOX ® |
| 99.75% weight | $NH_4OH$—$H_2O$ or KOH—$H_2O$ Solution with a pH of approximately 10–11 |
| | COMPOSITION 2 |
| 10% weight | Glycerol |
| 90% weight | $NH_4OH$—$H_2O$ or KOH—$H_2O$ Solution |
| | COMPOSITION 3 |
| 10% weight | Polyethylene Glycol |
| 90% weight | $NH_4OH$—$H_2O$ or KOH—$H_2O$ Solution |
| | COMPOSITION 4 |
| 5% weight | Polypropylene Glycol |
| 95% weight | $NH_4OH$—$H_2O$ or KOH—$H_2O$ Solution |
| | COMPOSITION 5 |
| 0.25% weight | CARBOPOL ® |
| 99.75% weight | $NH_4OH$—$H_2O$ or KOH—$H_2O$ Solution |

The lubricating planarizing solution 170 can be fabricated by mixing the lubricant-additive 160 with the non-abrasive solution 150 at a mixing site 114. The mixing site 114 generally provides turbulence to admix the non-abrasive solution 150 and the lubricant-additive 160. The mixing site 114, for example, can be a separate tank with an agitator (not shown), or the mixing site 114 can be a joint or an elbow in a line connecting the first container 110 to the second container 112. The mixing site 114 is coupled to the carrier head 132 by a conduit 115 to deliver the lubricating planarizing solution 170 to the nozzles 149 of the carrier head 132. The conduit 115 can be similar to those used to deliver abrasive planarizing slurries or non-abrasive planarizing solutions without lubricant-additives to web-format or rotary planarizing machines.

Figure 2:
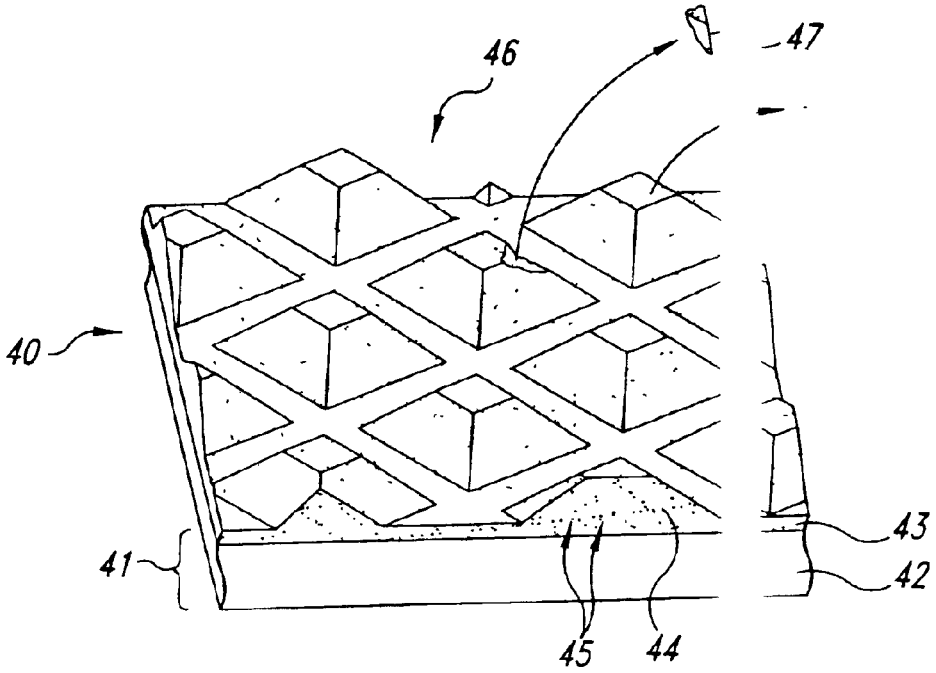
FIG. 2 is a partial isometric view of a fixed-abrasive polishing pad in accordance with the prior art.
Figure 4:
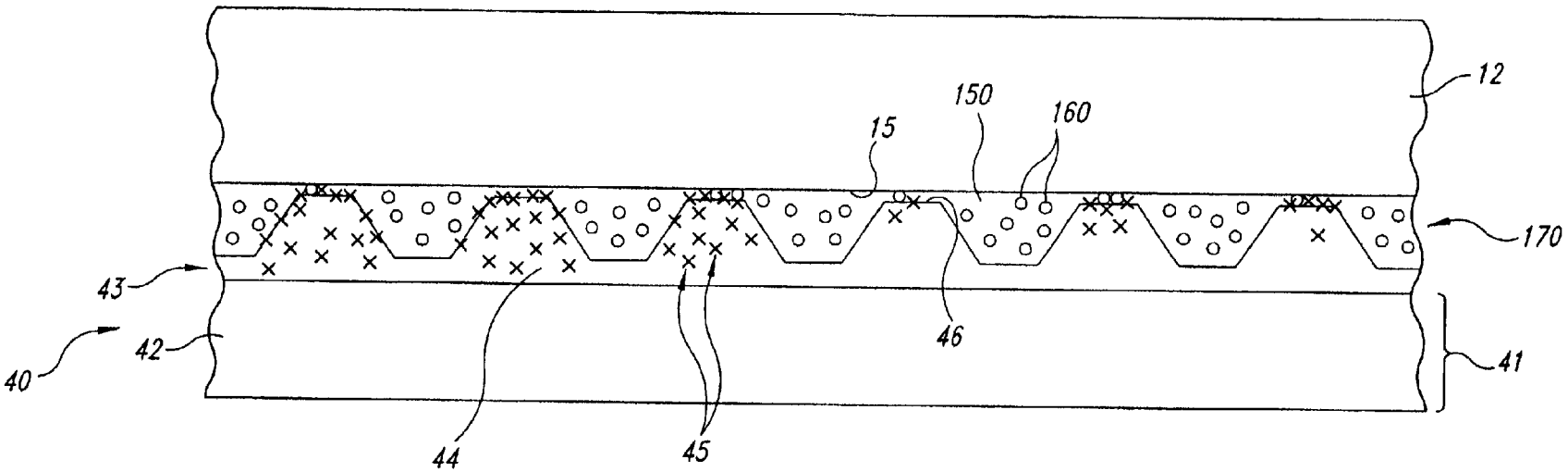
FIG. 4 is a schematic cross-sectional view of a lubricating planarizing solution further illustrating methods in accordance with an embodiment of the invention.

FIG. 4 is a schematic cross-sectional view of the substrate assembly 12 being planarized on a fixed-abrasive polishing pad 40 with the lubricating planarizing solution 170. The fixed-abrasive polishing pad 40 can be substantially the same as the pad 40 described above with reference to FIG. 2, and thus like reference numbers refer to like components. In operation, the lubricating planarizing solution 170 provides a protective boundary layer 172 between the front face 15 of the substrate assembly and the abrasive planarizing surface 46 at the top of the raised features. The boundary layer 172 of planarizing solution 170 separates regions of the front face 15 from the planarizing surface 46 to inhibit the fixed-abrasive particles 45 from overly abrading the front face 15. Thus, compared to planarizing solutions without the lubricant-additive 160, the lubricating planarizing solution 170 with the lubricant-additive 160 is expected to reduce defects and scratches on the front face 15 of the substrate assembly 12 in fixed-abrasive CMP processing.

From the foregoing it will be appreciated that, although specific embodiments of the invention have been described herein for purposes of illustration, various modifications may be made without deviating from the spirit and scope of the invention. For example, the process may be implemented using a rotary planarizing machine. Suitable rotary planarizing machines are manufactured by Applied Materials, Inc., Westech Corporation, and Strasbaugh Corporation, and suitable rotary planarizing machines are described in U.S. Pat. Nos. 5,456,627; 5,486,131; and 5,792,709, which are herein incorporated by reference. Accordingly, the invention is not limited except as by the appended claims.

What is claimed is:

1. A lubricating planarizing solution, comprising:

a non-abrasive solution without abrasive particles, the non-abrasive solution having a viscosity less than 4 cp; and a lubricant-additive mixed with the non-abrasive solution, the lubricant-additive comprising homopolymers and copolymers of acrylic acid crosslinked with a polyalkenyl polyether, having a viscosity greater than 4 cp, wherein the lubricating planarizing solution does not include abrasive particles and has a viscosity at least-greater than 4 cp, wherein the lubricant additive is present in the lubricating planarizing solution in an amount between 0.1% and 10% wt/wt.

2. The lubricating planarizing solution of claim 1 wherein:

the non-abrasive solution comprises water and ammonia.

3. The lubricating planarizing solution of claim 2 wherein the lubricating planarizing solution has a viscosity of 4–100 cp.

4. The lubricating planarizing solution of claim 2 wherein the lubricating planarizing solution has a viscosity of 10–20 cp.

5. The lubricating planarizing solution of claim 2 wherein the lubricant additive is, present in the lubricating planarizing solution in an amount of 0.25% wt/wt.

6. The lubricating planarizing solution of claim 1 wherein the lubricating planarizing solution has a viscosity of 4–100 cp.

7. The lubricating planarizing solution of claim 1 wherein the lubricating planarizing solution has a viscosity of 10–20 cp.

8. The lubricating planarizing solution of claim 1 wherein the lubricant additive is, present in the lubricating planarizing solution in an amount of 0.25% wt/wt.

* * * * *

UNITED STATES PATENT AND TRADEMARK OFFICE

CERTIFICATE OF CORRECTION

PATENT NO. : 6,903,018 B2
APPLICATION NO. : 09/915658
DATED : June 7, 2005
INVENTOR(S) : Gundu M. Sabde and Whonchee Lee It is certified that error appears in the above-identified patent and that said Letters Patent is hereby corrected as shown below:

Column 1,
Line 11, should read -- The present invention relates to methods and apparatuses for planarizing microelectronic substrate assemblies and, more particularly, to mechanical and/or chemical-mechanical planarization of such substrate assemblies using non-abrasive planarizing solutions and fixed-abrasive polishing pads --.

Column 4,
Line 60, "160 can be glycerol, polyethylene glycol polypropylene" should read -- 160 can be glycerol, polyethylene glycol, polypropylene --.

Signed and Sealed this

Twenty-seventh Day of June, 2006

JON W. DUDAS
*Director of the United States Patent and Trademark Office*